US012642295B2

(12) United States Patent
Tan et al.

(10) Patent No.: US 12,642,295 B2
(45) Date of Patent: Jun. 2, 2026

(54) COOLING FILTER ROD AND APPLICATION THEREOF

(71) Applicant: CHINA TOBACCO HUNAN INDUSTRIAL CO., LTD., Hunan (CN)

(72) Inventors: Haifeng Tan, Changsha (CN); Yong Jin, Changsha (CN); Hongmei Fan, Changsha (CN); Shitai Wang, Changsha (CN); Qian Chen, Changsha (CN); Ke Li, Changsha (CN); Saibo Yu, Changsha (CN); Qi Liu, Changsha (CN); Chao Tan, Changsha (CN)

(73) Assignee: China Tobacco Hunan Industrial Co., Ltd., Changsha (CN)

( * ) Notice: Subject to any disclaimer, the term of this patent is extended or adjusted under 35 U.S.C. 154(b) by 1118 days.

(21) Appl. No.: 17/256,167

(22) PCT Filed: Jun. 21, 2019

(86) PCT No.: PCT/CN2019/092306

§ 371 (c)(1),
(2) Date: Dec. 24, 2020

(87) PCT Pub. No.: WO2020/001383

PCT Pub. Date: Jan. 2, 2020

(65) Prior Publication Data

US 2021/0267269 A1 Sep. 2, 2021

(30) Foreign Application Priority Data

Jun. 26, 2018 (CN) ..... 201810667130.9
Jun. 26, 2018 (CN) ..... 201820988160.5
Jun. 26, 2018 (CN) ..... 201820988243.4

(51) Int. Cl.
*A24D 3/04* (2006.01)
*A24D 3/02* (2006.01)

(52) U.S. Cl.
CPC ..... *A24D 3/04* (2013.01); *A24D 3/0229* (2013.01); *A24D 3/0254* (2013.01)

(58) Field of Classification Search
None
See application file for complete search history.

(56) References Cited

U.S. PATENT DOCUMENTS 3,167,076 A * 1/1965 Mare ..... A24D 3/045 131/210
3,759,270 A 9/1973 Wright
5,392,793 A 2/1995 Molloy

FOREIGN PATENT DOCUMENTS

CN 2662666 Y 12/2004
CN 107536100 A 1/2018
(Continued)

OTHER PUBLICATIONS

International Search Report issued in International Application No. PCT/CN2019/092306 dated Sep. 3, 2019, 3 pages.
(Continued)

*Primary Examiner* — Michael J Felton
(74) *Attorney, Agent, or Firm* — MASCHOFF BRENNAN; Michael Mauriel; Ran Pang

(57) ABSTRACT

A cooling filter rod and an application thereof are disclosed. The filter rod comprises a hollow tube (1). The inside of the hollow tube (1) is provided with at least one plate (2) which partition the inside of the hollow tube and is perpendicular to the axis of the hollow tube (1). The area of the plate (2) is the same as the cross-sectional area of a hollow portion of the hollow tube (1) Each plate (2) is independently provided with at least one through hole (3). The cooling filter rod reduces the adsorption of cigarette smoke, greatly lowers the
(Continued)

smoke temperature felt by mouth, improves the sensory quality of cigarettes, and is suitable for application in new heat-not-burn cigarettes.

14 Claims, 2 Drawing Sheets

(56) References Cited

FOREIGN PATENT DOCUMENTS

| | | | | | |
|---|---|---|---|---|---|
| CN | 108113051 | A | | 6/2018 | |
| CN | 109288122 | A | | 2/2019 | |
| CN | 208446597 | U | | 2/2019 | |
| CN | 208624636 | U | | 3/2019 | |
| GB | 2294861 | A | * | 5/1996 | ..... A24D 3/045 |
| KR | 20030093631 | A | | 12/2003 | |

OTHER PUBLICATIONS

Communication pursuant to Article 94(3) EPC issued in European Patent Application No. 19826740.3 dated Dec. 11, 2024, 4 pages.

* cited by examiner

COOLING FILTER ROD AND APPLICATION THEREOF

CROSS REFERENCE TO RELATED APPLICATIONS

This application is a U.S. National Phase application under 35 U.S.C. § 371 of International Application No. PCT/CN2019/092306 filed on Jun. 21, 2019, which claims priority to Chinese Application No. 201810667130.9 filed on Jun. 26, 2018, Chinese Application No. 201820988243.4 filed on Jun. 26, 2018, and Chinese Application No. 201820988160.5 filed on Jun. 26, 2018. The entire contents of these applications are hereby incorporated herein by reference.

FIELD OF THE INVENTION

The present invention relates to a cigarette filter rod, in particular to a filter rod with ultra-low adsorption, which can maintain the smoke concentration and aroma concentration of a new tobacco product to the greatest extent, while greatly lowering the temperature of smoke felt by mouth, and an application thereof, belonging to the field of cigarette harm reduction.

BACKGROUND OF THE INVENTION

With the intensification of tobacco control campaigns and the increase of people's health awareness, new types of tobacco products have shown a trend of vigorous development in recent years. The new type of tobacco products are heated but not burnt, which reduces harmful ingredients produced by high-temperature combustion pyrolysis of tobacco, and greatly reduces the release of chemical ingredients of mainstream smoke. At the same time, different from a lot of smoke generated by smoldering of conventional cigarettes, their side stream smoke and environmental smoke will be greatly reduced, which alleviates the contradiction between smoking and smoking ban in public places to a certain extent.

However, due to small smoke amount and low smoke concentration of the new heat-not-burn cigarettes, the adsorption performance of conventional filter rods will further reduce consumer satisfaction, the frequency of smoking increases and the total amount of smoking increases accordingly; and the cigarettes are generally too short and too thin, and particularly require smoking sets for continuous heating, which easily causes higher temperature and burning sensation of smoke that enters the human mouth. These will greatly affect the smoking taste of such cigarettes and reduce the satisfaction of smokers. Thus, the acceptability of such cigarettes is affected, and the goal of reducing the harm of cigarettes cannot be achieved. Therefore, a cigarette filter rod that can effectively lower smoke temperature felt by mouth and maintain smoke concentration as much as possible is needed.

A lot of fruitful research has been carried out both inside and outside the industry on the material and structure of cigarette filters. Previous results show that in the last 2 to 3 puffs of traditional cigarettes near the end, the temperature of smoke at the filter can reach 70° C. to 80° C., and the temperature of smoke at the filter in a deep smoking mode is even more than 100° C. Too high filter temperature not only affects the entrapping effect of the filter on smoke aerosol particles in the filter, but also affects consumers' acceptance on the sensory quality of smoke. Others have studied the adding of a half-width partition and guide plate or a microporous device into the filter rod to guide the flow of smoke so as to achieve the effect of entrapping smoke, and the use of a polylactic acid film, aluminum foil paper, or the like as a cigarette filter rod to reduce the temperature of smoke. However, controlling the temperature of smoke and improving the sensory quality of smoke have always been the focus and difficulty in the design of new heat-not-burn cigarette filter rods.

SUMMARY OF THE INVENTION

In view of the defects of affected sensory quality causing by cigarette filters and too high smoke temperature of cigarette filters felt by mouth in the prior art, the first object of the present invention is to provide a cooling filter rod which greatly lowers smoke temperature felt by mouth and improves the sensory quality of a cigarette while reducing the absorption of cigarette smoke.

Another object of the present invention is to provide an application of the filter rod, which can be used as a cigarette filter with low adsorption and cooling functions, can reduce the burning sensation of high-temperature smoke while retaining the taste of a new heat-not-burn cigarette, and is especially suitable for the existing new heat-not-burn cigarettes with little smoke.

In order to achieve the above objects, the technical solution of the present invention is as follows:

A cooling filter rod includes a hollow tube; the inside of the hollow tube is provided with at least one plate which partitions the inside of the hollow tube and is perpendicular to the axis of the hollow tube, and each plate is provided with at least one through hole.

Further, the hollow tube is a hollow round tube, and the area of the plate is the same as the cross-sectional area of a hollow portion of the hollow round tube.

Further, the outer circumference of the hollow round tube is 15 to 24 mm.

Further, the wall of the hollow tube has a thickness of 0.5 to 2 mm.

Further, the hollow tube has a length of 10 to 40 mm, further 20 to 35 mm, and the inside of the hollow tube is provided with one to six plates. By controlling the number of plates, the hollow tube can be divided into a plurality of areas. Generally, if the layer number of plates is larger, the smoke temperature can be lowered more effective, but the smoking resistance to the cigarette and the smoke entrapment are greatly affected, so the preferred layer number of plates in each section of the hollow round tube is 1 to 6 to achieve the best comprehensive effect.

Further, the distance between any plate inside the hollow tube and any of two end ports of the hollow tube is not less than 2 mm, preferably, not less than 3 mm.

Further, the inside of the hollow tube is provided with two to six plates, and the distance between any two adjacent plates is within a range of 2 to 10 mm. If the distance is too short, the buffer diversion area is too small, which will affect the effect of throttling and cooling of the filter rod; if the distance is too long, the overall length design of the filter rod will be affected, the problems of too long cigarettes or mismatching lengths of the filter rod and the cigarette are easily caused, and smoking is felt empty, thereby reducing the acceptability of new heat-not-burn cigarettes. The distance between any two adjacent plates inside the hollow tube may be the same or different, and preferably the same.

Further, each plate has a thickness of 0.5 to 3 mm.

Further, each plate is independently provided with one to ten through holes, further one to six through holes, and preferably two to four through holes. Too many through holes make the process complicated and easily cause zero pressure drop through the filter rod to affect the effects of throttling and cooling. Each plate may be provided with different numbers or the same number of through holes, and preferably, each plate is provided with the same number of through holes.

Further, the through hole on each plate is arranged within a range of 0 to 3.0 mm, further 0 to 2.5 mm, from the center of the plate.

Further, there are at least two plates, and the relative positions of the through holes on the two adjacent plates are randomly distributed.

Further, the through holes on the two adjacent plates are at the same positions or distributed symmetrically along the central axis of the plates. When the through holes are symmetrically distributed around the central axis of the plates, the preparation process is simpler, and the effects of throttling and diversion (or shunting) are better. In addition, the smoke is in a diverted and shunted state in the hollow tube, which can effectively increase the flow path of smoke and further improve the cooling effect.

Further, the through holes on each plate are randomly distributed within a range of 0 to 3.0 mm, further 0 to 2.5 mm, from the center of the plate.

Further, the through holes on the same plate are uniformly distributed according to a geometric figure, including one of a triangle, a square or a polygon.

Further, the plate is made of at least one of resin, plastic, nylon, wood, organic glass, metal, and paper.

Generally, the through hole can theoretically be in any shape, and further, can be designed in the shape of circle, regular polygon, leaf or heart.

Further, the cross-sectional area of the through hole is 0.2 to 3.14 $mm^2$, generally 0.3 to 2.5 $mm^2$, and further 0.5 to 2 $mm^2$.

Further, the through hole is circular, with a diameter of 0.5 to 2 mm, and further 0.7 to 1.5 mm.

Based on the same inventive concept, the present invention further provides an application of the above-mentioned cooling filter rod in a cigarette filter.

In this way, the cigarette filter is given low adsorption and cooling functions, which effectively enhances the smoking experience.

Further, the cooling filter rod is used as a cigarette filter alone or combined with at least one of a cellulose acetate filter rod, a cut tobacco filter rod and a particulate filter rod to form a binary or multiple composite cigarette filter for use. Generally, there is no special requirement for the position of the cooling filter rod in the cigarette filter, and it can be placed near the lip end, near the cigarette end or in the middle. When used with the cellulose acetate filter rod (non-hollow tube cellulose acetate filter rod), the cellulose acetate filter rod is preferably near the lip end.

Further, the cigarette filter is a new heat-not-burn cigarette filter.

The main body of the cooling filter rod of the present invention is a hollow tube, the plates partition the hollow tube into a few independent areas through the design of the plates and the through holes in the hollow tube, the areas are communicated by designing the through holes with appropriate sizes on the plates, and during the cigarette smoking process, when the cigarette smoke passes through the hollow tube, the smoke achieves buffer diffusion and throttling pressure drop in each area to achieve the purpose of segmented throttling and cooling. In addition, the through holes with appropriate diameters effectively control the suction resistance of the filter rod, reduce smoke entrapment, increase smoke concentration, and lower smoke temperature. The existing similar cigarette filters with plates are mainly intended to improve the entrapment of smoke, but cannot achieve the effects of reducing smoke adsorption and lowering smoke temperature, and they generally adopt semi-circular or arc-shaped plates and cannot achieve the effects of throttling and cooling. Besides, the general size design of the through holes is unreasonable. Some through holes are too small, which easily increases the suction resistance of the filter rod significantly to entrap smoke. Some other through holes are too large to achieve the effects of throttling and cooling. The cooling filter rod of the present invention is particularly suitable for new heat-not-burn tobacco products (cigarettes that emit smoke by heating) in the prior art. The existing new cigarettes have the characteristics of small smoke amount and low smoke concentration, while the conventional filter rods have strong adsorption performance, which will further affect consumers' satisfaction with the sensory quality of cigarettes, reduces the acceptability, also increases the smoking frequency and increases the total amount of smoking. At the same time, the new heat-not-burn cigarettes are usually too short and too thin, which are required to be heated continuously by smoking sets, thus may cause a high temperature of smoke entering the human mouth and a burning sensation. These will affect the smoking experience and the acceptability of the cigarettes. The cooling filter rod of the present invention well solves the problems exist in the filter rods of the new heat-not-burn tobacco products. The entrapment and adsorption of the smoke by the cooling filter rod can be reduced, the temperature of the cigarette smoke felt by mouth can be lowered, and the consumers satisfaction can be improved.

The material used in the hollow tube of the present invention may be the same as or different from the material of the plate. Optionally, the hollow tube is made of at least one of resin, plastic, nylon, wood, organic glass, metal, paper, acetate fibers, polypropylene fibers or polylactic acid fibers.

In the present invention, a preparation of a cylindrical cooling filter rod includes: first preparing a mold of hollow semi-cylinder with the plate having the through-hole thereon, and non-circular surfaces are divided into two types: "male" non-circular surface and "female" non-circular surface, wherein slivers protruding forward and having a length of 0.5 to 1 mm and a thickness of 0.1 to 0.5 mm are distributed on a cylindrical end face and an end face of the plate on the "male" non-circular surface, and clamping grooves having a length of 0.5 to 1 mm and a thickness of 0.1 to 0.5 mm are correspondingly distributed on a cylindrical end face and an end face of the plate on the "female" non-circular surface; then performing injection molding, locking the hollow semi-cylinder having a "male" non-circular surface with the hollow semi-cylinder having a "female" non-circular surface by buckling to form a complete cylindrical cooling filter rod, and cutting into suitable lengths of filter rods for cigarettes or for compounding with other material. 3D printing may also be used, including: processing to form a cylindrical cooling filter rod with a slot and a plate with a through hole, and inserting the plates with through holes into the slots in a combined manner for molding. This method can process a filter rod with auxiliary ventilation function for a filter rod easily, and can form a cooling filter rod which has a plate with a through-hole at one time.

Compared with the prior art, the technical solution of the present invention brings about the following beneficial technical effects:

The cooling filter rod of the present invention is an ultra-low adsorption filter rod. Through a simple and ingenious structure design, the adsorption and entrapment of cigarette smoke are reduced as much as possible, the smoke concentration and aroma concentration are maintained, and the temperature of cigarette smoke felt by mouth is greatly lowered. The filter rod adopts a hollow tube main body to reduce the adsorption of smoke by the filter rod. One or more plates are designed in the hollow tube to partition smoke channels into a few units, so that the cigarette smoke is buffered and diverted therein. At the same time, the through holes with appropriate sizes effectively control the suction resistance of the filter rod, reduce the entrapment of smoke, and realize multi-section throttling and cooling. Therefore, the comprehensive design of the filter rod of the present invention can not only completely maintain the smoke concentration and aroma concentration of tobacco products, make the smoke full of bundles, and bring a unique and perfect smoking experience; but also can greatly lower the smoke temperature felt by mouth and improve the sensory quality of cigarettes.

The cooling filter rod of the present invention has the advantages of simple structure design, readily available raw materials and low cost, which is beneficial to large-scale production.

The cooling filter rod of the present invention can not only completely maintain the smoke concentration and aroma concentration of tobacco products, but also can greatly lower the smoke temperature felt by mouth, and is particularly suitable for the existing new heat-not-burn tobacco products.

In which: 1 hollow tube, 2 plate, 3 through hole, 4 cellulose acetate filter rod.

DETAILED DESCRIPTION OF EMBODIMENTS

The following embodiments are to further illustrate the present invention, but not to limit the protection scope of the present invention.

Embodiments 1-3

Figure 3:
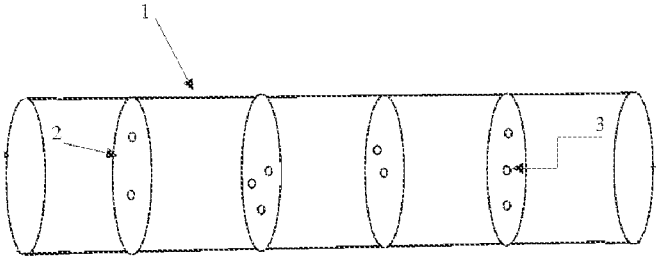
FIG. 3 is a schematic structural diagram of still another filter rod according to the present invention.

The following three kinds of filter rods with a length of 30 mm and a circumference of 24.0 mm are prepared first:

One of them is a hollow cylindrical filter rod with four plates which partition the inside of the hollow tube and circular through holes on each plate, every hollow cylinder has a thickness of 0.8 mm, and every plate has a thickness of 0.8 mm. Each plate has two or three through holes. The first plate is 4 mm from the mouth end and has two through holes thereon, the second plate is 12 mm from the mouth end and has three through holes thereon, the third plate is 16 mm from the mouth end and has two through holes thereon, and the fourth plate is 24 mm from the mouth end and has three through holes thereon. The centers of the through holes are randomly distributed within a range of 0 to 2.5 mm from the center of the plate, and every through hole has a diameter of 1.5 mm. This filter rod is denoted as 3# (as shown in FIG. 3).

Figure 5:
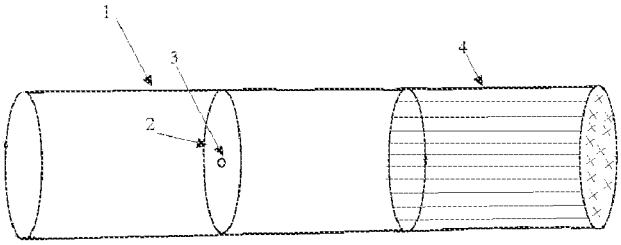
FIG. 5 is a schematic structural diagram of a composite filter rod according to the present invention.
Figure 6:
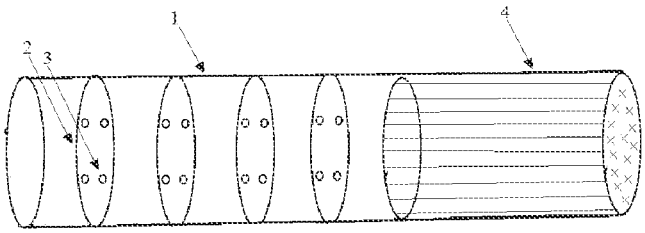
FIG. 6 is a schematic structural diagram of another composite filter rod according to the present invention.

The other two are binary composite filter rods, and their composite structures are both compounded of a 20 mm long hollow cylindrical filter rod and a 10 mm long cellulose acetate filter rod near the lip end, the 20 mm long hollow cylindrical filter rod has a plate which partitions the inside of the hollow tube, the plate has a circular through hole thereon. One of the binary composite filter rods includes one plate, the hollow cylinder has a thickness of 1.5 mm, the plate has a thickness of 2 mm and is provided with one through hole, the through hole is in the center of the cross-sectional circle of the filter rod and has a diameter of 1.5 mm, the plate is 10 mm from the mouth end, and this filter rod is denoted as 5# (as shown in FIG. 5). The other binary composite filter rod includes four plates, each throttling plate has four circular through holes, the center of each through hole is 2 mm from the center of the cross-sectional circle of the filter rod, the four through holes are distributed in a square shape on the cross-sectional circle of the filter rod, the through holes on the adjacent plates are at the same positions, every through hole has a diameter of 1 mm, both of the outer wall of the hollow cylinder and each plate have a thickness of 0.8 mm, the distances between the first plate and the mouth end and between the adjacent plates are both 4 mm, and this filter rod is denoted as 6# (as shown in FIG. 6).

Comparative Examples 1-2

A cylindrical hollow tube type cellulose acetate composite filter rod with the same length of 30 mm and the same circumference of 24.0 mm as those of the filter rods in Embodiments 1-3, it does not have plate which partitions the inside of the hollow tube and is denoted as 0A#, its composite structure is composed of a 10 mm long cellulose acetate filter rod and a 20 mm long hollow filter rod, and the cellulose acetate filter rod is near the lip end. An ordinary cellulose acetate filter rod with the same length of 30 mm and the same circumference of 24.0 mm as those of the filter rods in Embodiments 1-3 is denoted as 0B#.

The above five kinds of filter rods are respectively rolled with cigarettes of the same technical formula into new heat-not-burn cigarettes with a length of 48 mm and a circumference of 24.3 mm. The cigarettes are numbered identically to the number of the filter rods. The cigarettes are heated by the same smoking set, the maximum heating temperature is 350° C., the cigarettes are smoked according to the ISO standard method, the maximum smoke temperatures at the lip ends of the outer edges of the filters are tested, and the smoke results are shown in Table 1:

TABLE 1

| Cigarette number | Maximum smoke temperature (lip end) (° C.) | Tar (mg) | Nicotine (mg) |
|---|---|---|---|
| 3# | 51 | 2.2 | 0.65 |

TABLE 1-continued

| Cigarette number | Maximum smoke temperature (lip end) (° C.) | Tar (mg) | Nicotine (mg) |
|---|---|---|---|
| 5# | 73 | 1.4 | 0.35 |
| 6# | 59 | 1.6 | 0.37 |
| 0A# | 86 | 1.3 | 0.32 |
| 0B# | 79 | 0.5 | 0.13 |

It can be seen from Table 1 that the 3#, 5# and 6# filter rods are applied to the new heat-not-burn cigarettes with the circumference of 24.3 mm; and compared with the ordinary cellulose acetate filter rod 0B#, the maximum temperatures of smoke at the lip ends of the outer edges of the measured filters are greatly lowered, and the tar and nicotine in the smoke are greatly increased.

The 3# filter rod is applied to the new heat-not-burn cigarette with the circumference of 24.3 mm; and compared with the cellulose acetate hollow tube composite filter rod 0A#, the maximum temperature of smoke at the lip end of the outer edge of the filter is greatly lowered, and the ingredients such as tar and nicotine in the smoke are greatly increased. Compared with the cellulose acetate hollow tube binary composite filter rod 0A#, the application of the 5# and 6# filter rods achieves that the maximum temperatures of smoke at the lip ends of the outer edges of the measured filters are also obviously lowered, and the differences in tar and nicotine in the smoke are small.

Moreover, during the cigarette smoking process of the 0A# and 0B# filter rods, the bad phenomenon of agglomeration formed by melting shrinkage occurs on the sides of the cellulose acetate filter rods close to the heating zones of the smoking sets under the influence of high-temperature smoke, so that the suction resistance increases and the amount of smoke decreases significantly from the third puff or even the second puff. This phenomenon is more serious in the 0B# cellulose acetate filter rod, but not obvious in the 5# and 6# composite filter rods having the effect of lowering the temperature of smoke.

The filter rod of the present invention greatly lowers the maximum temperature of smoke at the lip end of the outer edge of the filter while reducing the absorption of cigarette smoke. The entrapment and adsorption of smoke of the new heat-not-burn cigarette by the cigarette filter rod are effectively reduced, the temperature of the cigarette smoke felt by mouth is lowered, the sensory quality of the cigarette is improved, and the consumers' satisfaction is improved.

Embodiments 4-5

The following two kinds of filter rods with a length of 30 mm and a circumference of 16.8 mm are prepared first:

One of them is a hollow cylindrical filter rod with four plates which partition the inside of the hollow tube, and there are circular through holes on each plate, every hollow cylinder has a thickness of 0.8 mm, and every plate has a thickness of 0.8 mm. Each plate has two or three through holes. The first plate is 4 mm from the mouth end and has two through holes thereon, the second plate is 12 mm from the mouth end and has three through holes thereon, the third plate is 16 mm from the mouth end and has two through holes thereon, and the fourth plate is 24 mm from the mouth end and has three through holes thereon. The centers of the through holes are randomly distributed within a range of 0 to 1.2 mm from the center of the plate, and the through holes have a diameter of 1 mm. This filter rod is denoted as 9#.

The other is a binary composite filter rod, and its composite structure is compounded of a 20 mm long hollow cylindrical filter rod and a 10 mm long cellulose acetate filter rod near the lip end, the 20 mm long hollow cylindrical filter rod has a plate which partitions the inside of the hollow tube, the plate has a circular through hole thereon. The binary composite filter rod includes one plate, the hollow cylinder has a thickness of 1.5 mm, the plate has a thickness of 2 mm and is provided with one through hole, the through hole is in the center of the cross-sectional circle of the filter rod and has a diameter of 1.5 mm, and the plate is 10 mm from the mouth end. This binary composite filter rod is denoted as 11#.

Comparative Examples 3-4

A cylindrical hollow tube type cellulose acetate composite filter rod with the same length of 30 mm and the same circumference of 16.8 mm as the filter rods in Embodiments 4-5, it does not have plate which partitions the inside of the hollow tube and is denoted as 0C#, its composite structure is composed of a 10 mm long cellulose acetate filter rod and a 20 mm long hollow filter rod, and the cellulose acetate filter rod is near the lip end. An ordinary cellulose acetate filter rod with the same length of 30 mm and the same circumference of 16.8 mm is denoted as 0D#.

The above four kinds of filter rods are respectively rolled with cigarettes of the same technical formula into new fine heat-not-burn cigarettes with a length of 70 mm and a circumference of 17.1 mm. The cigarettes are numbered identically to the number of the filter rods. The new fine cigarettes are heated by the same smoking set, the maximum heating temperature is 230° C., the cigarettes are smoked according to the ISO standard method, the maximum smoke temperatures at the lip ends of the outer edges of the filters are tested, and the smoke results are shown in Table 2:

TABLE 2

| Cigarette number | Maximum smoke temperature (lip end) (° C.) | Tar (mg) | Nicotine (mg) |
|---|---|---|---|
| 9# | 56 | 4.7 | 0.28 |
| 11# | 67 | 3.2 | 0.13 |
| 0C# | 79 | 3.2 | 0.12 |
| 0D# | 70 | 1.2 | 0.05 |

It can be seen from Table 2 that the 9# and 11# filter rods are applied to the new heat-not-burn cigarettes with the circumference of 17.1 mm; and compared with the ordinary cellulose acetate filter rod 0D#, the maximum temperatures of smoke at the lip ends of the outer edges of the filters are greatly lowered, and the tar, nicotine and moisture in the smoke are greatly increased.

The 9# filter rod is applied to the new heat-not-burn cigarette with the circumference of 17.1 mm; and compared with the cellulose acetate hollow tube composite filter rod 0C#, the maximum temperature of smoke at the lip end of the outer edge of the filter is greatly lowered, and the tar and nicotine in the smoke are greatly increased. Compared with the cellulose acetate hollow tube binary composite filter rod 0C#, the application of the 11# filter rod achieves that the maximum temperature of smoke at the lip end of the outer edge of the filter is also obviously lowered, and the differences in tar and nicotine in the smoke are small. Moreover, during the cigarette smoking process of the 0C# and 0D# filter rods, the bad phenomenon of agglomeration formed by melting shrinkage occurs on the sides of the cellulose acetate filter rods close to the heating zones of the smoking sets under the influence of high-temperature smoke, so that the suction resistance increases and the amount of smoke decreases significantly from the third puff or even the second puff. This phenomenon is more serious in the 0D# cellulose acetate filter rod, but not obvious in the 11# composite filter rod having the effect of lowering the temperature of smoke.

Embodiments 6-12

Figure 1:
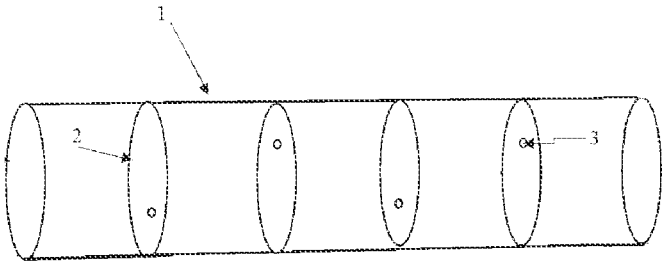
FIG. 1 is a schematic structural diagram of a filter rod according to the present invention.
Figure 2:
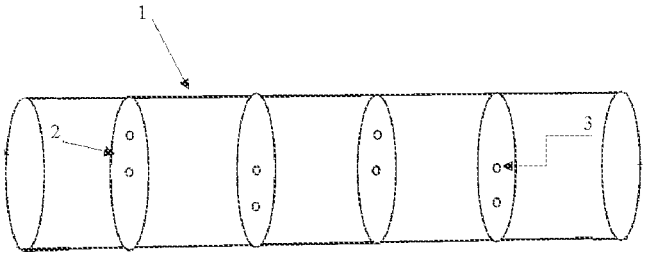
FIG. 2 is a schematic structural diagram of another filter rod according to the present invention.

The following seven kinds of filter rods with a length of 34 mm and a circumference of 22.0 mm are prepared first:

Three of them are hollow cylindrical filter rods with four plates which partition the inside of the hollow tube, and the plate has a circular through hole thereon, every hollow cylinder has a thickness of 0.8 mm, and every plate has a thickness of 0.8 mm. In the first one of the three hollow cylindrical filter rods, each plate has one through hole, the center of the through hole is 2 mm from the center of the cross-sectional circle of the filter rod, the through holes on the adjacent plates are symmetrically distributed around the center of the circle, the through holes on any two plates, which are separated by another plate, are at the same positions, the through holes have a diameter of 1.2 mm, the distances between the first plate and the mouth end and between the adjacent plates are both 6 mm, and this filter rod is denoted as A1# (as shown in FIG. 1); in the second one of the three hollow cylindrical filter rods, each plate has two circular through holes, one of the through holes is in the center of the cross-sectional circle of the filter rod, the center of the other through hole is 2 mm from the center of the cross-sectional circle of the filter rod, the through holes on the adjacent plates are symmetrically distributed around the center of the circle, the through holes on any two plates, which are separated by another plate, are at the same positions, every through hole has a diameter of 1.0 mm, the distances between the first plate and the mouth end and between the adjacent plates are both 6 mm, and this filter rod is denoted as A2# (as shown in FIG. 2); and in the third one of the three hollow cylindrical filter rods, each plate has two or three through holes, the first plate is 4 mm from the mouth end and has two through holes thereon, the second plate is 12 mm from the mouth end and has three through holes thereon, the third plate is 16 mm from the mouth end and has two through holes thereon, the fourth plate is 24 mm from the mouth end and has three through holes thereon, the centers of the through holes are randomly distributed within a range of 0 to 2.1 mm from the center of the plate, every through hole has a diameter of 1.0 mm, and this filter rod is denoted as A3# (as shown in FIG. 3).

Figure 4:
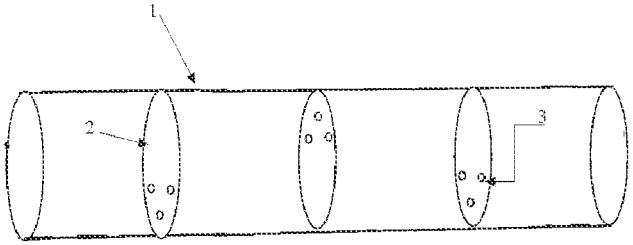
FIG. 4 is a schematic structural diagram of still another filter rod according to the present invention.

The other one in the seven kinds of filter rods is a hollow cylindrical filter rod with three plates which partition the inside of the hollow tube and circular through holes on each plate, the hollow cylinder has a thickness of 0.8 mm, and every plate has a thickness of 0.8 mm. Each plate has three through holes, the centers of the through holes are on one side of the center of the cross-sectional circle of the filter rod and are 2 mm from the center of the cross-sectional circle of the filter rod, the through holes are triangularly distributed, the through holes on the adjacent plates are symmetrically distributed around the center of the circle, the through holes on any two plates, which are separated by another plate, are at the same positions, the through holes have a diameter of 1.0 mm, the first plate is 4 mm from the mouth end, and the distance between the adjacent plates is 10 mm. This filter rod is denoted as A4# (As shown in FIG. 4).

The other two in the seven kinds of filter rods are binary composite filter rods, and their composite structures are both compounded of a 27 mm long hollow cylindrical filter rod and a 7 mm long cellulose acetate filter rod near the lip end, the 27 mm long hollow cylindrical filter rod has a plate which partitions the inside of the hollow tube, the plate has a circular through hole thereon. One of the binary composite filter rods includes one plate, the hollow cylinder has a thickness of 1.5 mm, the plate has a thickness of 2 mm and is provided with one through hole, the through hole is in the center of the cross-sectional circle of the filter rod and has a diameter of 1.2 mm, the plate is 8 mm from the cellulose acetate filter rod, and this filter rod is denoted as A5# (as shown in FIG. 5). The other binary composite filter rod includes four plates, each throttling plate has four circular through holes, the center of each through hole is 2 mm from the cross-sectional circle of the filter rod, the four through holes are distributed in a square shape on the cross-sectional circle of the filter rod, the through holes on the adjacent plates are at the same positions, every through hole has a diameter of 0.9 mm, both of the outer wall of the hollow cylinder and each plate have a thickness of 0.8 mm, the distances between the first plate and the cellulose acetate filter rod and between the adjacent plates are both 4 mm, and this filter rod is denoted as A6# (as shown in FIG. 6).

Another binary composite filter rod is prepared, and its composite structure is compounded of a 27 mm long hollow cylindrical filter rod and a 7 mm long cellulose acetate filter rod near the lip end, the 27 mm long hollow cylindrical filter rod has a plate which partitions the inside of the hollow tube, the plate has a circular through hole thereon. The hollow cylindrical filter rod includes four plates, the hollow cylinder has a thickness of 0.8 mm, the plate has a thickness of 0.8 mm, each plate has one through hole, the through hole is in the center of the cross-sectional circle of the filter rod and has a diameter of 2.5 mm, and the distances between the first plate and the mouth end and between the adjacent plates are both 4 mm. This filter rod is denoted as F1#.

Comparative Example 5

A cylindrical hollow tube type cellulose acetate composite filter rod with the same length of 34 mm and the same circumference of 22.0 mm, the filter rod does not have plate which partitions the inside of the hollow tube and is denoted as A0#, its composite structure is composed of a 7 mm long cellulose acetate filter rod and a 27 mm long hollow filter rod, and the cellulose acetate filter rod is near the lip end.

The above eight kinds of filter rods are respectively rolled with cigarettes of the same technical formula into new heat-not-burn cigarettes with a length of 46 mm and a circumference of 22.6 mm. The cigarettes are numbered identically to the number of the filter rods. The cigarettes are heated by the same smoking set, the maximum heating temperature is 300-350° C., the cigarettes are smoked according to the ISO standard method, the maximum smoke temperatures at the lip ends of the outer edges of the filters are tested, and the smoke results are shown in Table 3:

TABLE 3

| Cigarette number | Maximum smoke temperature (lip end) (° C.) | Tar (mg) | Nicotine (mg) |
|---|---|---|---|
| A1# | 62 | 3.1 | 0.55 |
| A2# | 51 | 3.2 | 0.61 |

TABLE 3-continued

| Cigarette number | Maximum smoke temperature (lip end) (° C.) | Tar (mg) | Nicotine (mg) |
|---|---|---|---|
| A3# | 54 | 3.4 | 0.65 |
| A4# | 56 | 3.4 | 0.66 |
| A5# | 75 | 2.1 | 0.34 |
| A6# | 58 | 2.3 | 0.37 |
| F1# | 89 | 1.9 | 0.31 |
| A0# | 88 | 1.9 | 0.30 |

As can be seen from Table 3, the A1#, A2#, A3# and A4# filter rods are applied to the new heat-not-burn cigarettes with the circumference of 22.6 mm; and compared with the cellulose acetate hollow tube composite filter rod A0#, the maximum temperatures of smoke at the lip ends of the outer edges of the filters are greatly lowered, and the ingredients such as tar and nicotine in the smoke are greatly increased. Compared with the cellulose acetate hollow tube composite filter rod A0#, the application of the 5# and 6# filter rods achieves that the maximum temperatures of smoke at the lip ends of the outer edges of the measured filters are also obviously lowered, and the differences in tar and nicotine in the smoke are small.

Moreover, during the cigarette smoking process of the A0# filter rod, the bad phenomenon of agglomeration formed by melting shrinkage occurs on the side of the cellulose acetate filter rod close to the heating zone of the smoking set under the influence of high-temperature smoke, so that the suction resistance increases and the amount of smoke decreases significantly from the third puff or even the second puff.

Because the 5# and 6# composite filter rods can effectively lower the temperature of smoke, the bad phenomenon of agglomeration formed by melting shrinkage is not obvious on the cellulose acetate filter rod.

During the cigarette smoking process, because the diameter of the through holes is too large, the smoking characteristics of the F1# filter rod are close to those of the A0# filter rod, and the maximum temperature of smoke at the lip end of the outer edge of the measured filter is not effectively lowered. The bad phenomenon of agglomeration formed by melting shrinkage also occurs on the cellulose acetate filter rod.

Embodiments 13-19

The following seven kinds of filter rods with a length of 30 mm and a circumference of 16.8 mm are prepared first:

Two of them are hollow cylindrical filter rods with four plates which partition the inside of the hollow tube and a circular through hole on each plate, every hollow cylinder has a thickness of 0.8 mm, and every plate has a thickness of 0.8 mm. In the first hollow cylindrical filter rod, each plate has one through hole, the center of the through hole is 1 mm from the center of the cross-sectional circle of the filter rod, the through holes on the adjacent plates are symmetrically distributed around the center of the circle, the through holes on any two plates, which are separated by another plate, are at the same positions, the through holes have a diameter of 1.2 mm, the distances between the first plate and the mouth end and between the adjacent plates are both 6 mm, and this filter rod is denoted as B1#; and in the second hollow cylindrical filter rod, each plate has two circular through holes, the centers of the through holes are randomly distributed within a range of 0 to 1.2 mm from the center of the plate, the through holes have a diameter of 1 mm, the distances between the first plate and the mouth end and between the adjacent plates are both 6 mm, and this filter rod is denoted as B2#.

The third one in the seven kinds of filter rods is a hollow cylindrical filter rod with five plates which partition the inside of the hollow tube and a circular through hole on each plate, every hollow cylinder has a thickness of 0.7 mm, and every plate has a thickness of 1 mm. Each plate has two or three circular through holes. The first plate is 4 mm from the mouth end and has two through holes thereon, the second plate is 8 mm from the mouth end and has three through holes thereon, the third plate is 12 mm from the mouth end and has two through holes thereon, the fourth plate is 20 mm from the mouth end and has three through holes thereon, and the fifth plate is 24 mm from the mouth end and has two through holes thereon. The centers of the through holes are randomly distributed within a range of 0 to 1.4 mm from the center of the plate, and the through holes have a diameter of 0.9 mm. This filter rod is denoted as B3#.

The other one in the seven kinds of filter rods is a hollow cylindrical filter rod with three plates which partition the inside of the hollow tube and a circular through hole on each plate, every hollow cylinder has a thickness of 0.8 mm, and every plate has a thickness of 0.8 mm. Each plate has three through holes, the centers of the through holes are 1.2 mm from the center of the cross-sectional circle of the filter rod and are triangularly distributed, the through holes on the adjacent plates are symmetrically distributed around the center of the circle, the through holes on any two plates, which are separated by another plate, are at the same positions, the through holes have a diameter of 0.8 mm, the first plate is 4 mm from the mouth end, and the distance between the adjacent plates is 10 mm. This filter rod is denoted as B4#.

The other two in the seven kinds of filter rods are binary composite filter rods, and their composite structures are both compounded of a 23 mm long hollow cylindrical filter rod and a 7 mm long cellulose acetate filter rod near the lip end, the 23 mm long hollow cylindrical filter rod has a plate which partitions the inside of the hollow tube and has a circular through hole thereon; one of the binary composite filter rods includes one plate, the hollow cylinder has a thickness of 1.5 mm, the plate has a thickness of 2 mm and is provided with one through hole, the through hole is in the center of the cross-sectional circle of the filter rod and has a diameter of 1 mm, the plate is 8 mm from the cellulose acetate filter rod, and this filter rod is denoted as B5#; and the other binary composite filter rod includes four plates, each plate has four through holes, the center of each through hole is 1.2 mm from the cross-sectional circle of the filter rod, the four through holes are distributed in a square shape on the cross-sectional circle of the filter rod, the through holes on the adjacent plates are at the same positions, every through hole has a diameter of 0.8 mm, the outer wall of the hollow cylinder and each plate both have a thickness of 0.8 mm, the distances between the first plate and the cellulose acetate filter rod and between the adjacent plates are both 4 mm, and this filter rod is denoted as B6#. Another binary composite filter rod is prepared, and its composite structure is compounded of a 23 mm long hollow cylindrical filter rod and a 7 mm long cellulose acetate filter rod near the lip end, the 23 mm long hollow cylindrical filter rod has a plate which partitions the inside of the hollow tube and has a circular through hole thereon. The hollow cylindrical filter rod has one plate, the plate is 6 mm from the cellulose acetate filter rod, the hollow cylinder has a thickness of 0.8 mm, the plate has a thickness of 1 mm and is provided with six through holes, the centers of the through holes are randomly distributed within a range of 0 to 1.5 mm from the center of the plate, and the through holes have a diameter of 0.4 mm. This filter rod is denoted as F2#.

Comparative Example 6

A cylindrical hollow tube type cellulose acetate composite filter rod with the same length of 30 mm and the same circumference of 16.8 mm, the filter rod does not have plate which partitions the inside of the hollow tube and is denoted as B0#, its composite structure is composed of a 7 mm long cellulose acetate filter rod and a 23 mm long hollow filter rod, and the cellulose acetate filter rod is near the lip end.

The above eight kinds of filter rods are respectively rolled with cigarettes of the same technical formula into new fine heat-not-burn cigarettes with a length of 72 mm and a circumference of 17.1 mm. The cigarettes are numbered identically to the number of the filter rods. The new fine cigarettes are heated by the same smoking set, the maximum heating temperature is 230-280° C., the cigarettes are smoked according to the ISO standard method, the maximum smoke temperatures at the lip ends of the outer edges of the filters are tested, and the smoke results are shown in Table 4:

TABLE 4

| Cigarette number | Maximum smoke temperature (lip end) (° C.) | Tar (mg) | Nicotine (mg) |
|---|---|---|---|
| B1# | 63 | 4.5 | 0.27 |
| B2# | 55 | 4.8 | 0.27 |
| B3# | 52 | 5.1 | 0.33 |
| B4# | 57 | 4.9 | 0.31 |
| B5# | 68 | 3.0 | 0.18 |
| B6# | 61 | 3.3 | 0.20 |
| F2# | 32 | 0.3 | 0.02 |
| B0# | 81 | 3.0 | 0.17 |

As can be seen from Table 4, the B1#, B2#, B3# and B4# filter rods are applied to the new heat-not-burn cigarettes with the circumference of 17.1 mm; and compared with the cellulose acetate hollow tube composite filter rod B0#, the maximum temperatures of smoke at the lip ends of the outer edges of the filters are greatly lowered, and the tar and nicotine in the smoke are greatly increased. Compared with the cellulose acetate hollow tube composite filter rod B0#, the application of the B5# and B6# filter rods achieves that the maximum temperatures of smoke at the lip ends of the outer edges of the filters are also obviously lowered, and the differences in tar and nicotine in the smoke are small.

Regarding the F2# filter rod, during the cigarette smoking process, because the diameter of the through hole is too small, although the maximum temperature of smoke at the lip end of the outer edge of the measured filter is relatively low, the amount of smoke is too small during smoking, the tar and nicotine in the smoke are too low, the suction resistance will be large and the feeling of empty smoking will be obvious.

Moreover, during the cigarette smoking process of the B0# filter rod, the bad phenomenon of agglomeration formed by melting shrinkage occurs on the side of the cellulose acetate filter rod close to the heating zone of the smoking set under the influence of high-temperature smoke, so that the suction resistance increases and the amount of smoke decreases significantly from the third puff or even the second puff. Because the B5# and B6# composite filter rods can effectively lower the temperature of smoke, the bad phenomenon of agglomeration formed by melting shrinkage is not obvious on the cellulose acetate filter rod.

The cooling filter rod of the present invention lowers the maximum temperature of smoke at the lip end of the outer edge of the filter while reducing the absorption of cigarette smoke. The entrapment and adsorption of smoke of the new heat-not-burn cigarette by the cigarette filter rod are effectively reduced, the temperature of the cigarette smoke felt by mouth is lowered, the sensory quality of the cigarette is improved, and the consumers' satisfaction is improved.

The invention claimed is:

1. A cooling filter rod, comprising:

a hollow tube, wherein:

inside of the hollow tube is provided with two to six plates which partition the inside of the hollow tube and are perpendicular to an axis of the hollow tube;

a distance between any two adjacent plates is within a range of about 2 to about 10 mm, and each plate is provided with two to six through-holes; the through-holes are circular, with a diameter of 1.2 to 1.5 mm.

2. The cooling filter rod according to claim 1, wherein:

the hollow tube is a hollow round tube, and an area of a plate is the same as a cross-sectional area of a hollow portion of the hollow round tube.

3. The cooling filter rod according to claim 1, wherein:

the hollow tube has a length of about 10 to about 40 mm, and the inside of the hollow tube is provided with one to six plates.

4. The cooling filter rod according to claim 1, wherein the distance between any plate inside the hollow tube and any of two end ports of the hollow tube is not less than about 2 mm.

5. The cooling filter rod according to claim 1, wherein each plate has a thickness of about 0.5 to about 3 mm.

6. The cooling filter rod according to claim 1, wherein the through-holes on each plate are arranged within a range of about 0 to about 3.0 mm from the center of the plate.

7. The cooling filter rod according to claim 1, wherein:

relative positions of the through-holes on the any two adjacent plates are randomly distributed; or the through-holes on the any two adjacent plates are at the same positions or distributed symmetrically around a central axis of the plates.

8. The cooling filter rod according to claim 1, wherein:

the through-holes on the each plate are randomly distributed within a range of about 0 to about 3.0 mm from the center of a plate; or the through-holes on the same plate are uniformly distributed according to a geometric figure, comprising one of a triangle, a square, or a polygon.

9. The cooling filter rod according to claim 1, wherein the through-holes are in a shape of at least one of circle, regular polygon, leaf, and heart.

10. The cooling filter rod according to claim 1, wherein a cross-sectional area of a through-hole is about 0.2 to about 3.14 $mm^2$.

11. A cigarette filter, comprising a cooling filter rod, wherein the cooling filter rod comprises:

a hollow tube, wherein:

inside of the hollow tube is provided with two to six plates which partition the inside of the hollow tube and are perpendicular to an axis of the hollow tube; a distance between any two adjacent plates is within a range of about 2 to about 10 mm, and each plate is provided with two to six through-holes, the through-holes are circular, with a diameter of 1.2 to 1.5 mm.

12. The cigarette filter according to claim 11, further comprising: at least one of a cellulose acetate filter rod, a cut tobacco filter rod, and a particulate filter rod, wherein the at least one of a cellulose acetate filter rod, a cut tobacco filter rod, and a particulate filter rod is combinable with the cooling filter rod to form a binary or multiple composite cigarette filter.

13. The cigarette filter according to claim 11, wherein the cigarette filter is a new heat-not-burn cigarette filter.

14. A preparation method of the cooling filter rod according to claim 1, comprising:

preparing a mold of hollow semi-cylinder with a plate having a through-hole thereon, dividing non-circular surfaces into two types: a "male" non-circular surface and a "female" non-circular surface, distributing slivers protruding forward and having a length of about 0.5 to about 1 mm and a thickness of about 0.1 to about 0.5 mm on a cylindrical end face and an end face of the plate on the "male" non-circular surface, and distributing clamping grooves having a length of about 0.5 to about 1 mm and a thickness of about 0.1 to about 0.5 mm correspondingly on a cylindrical end face and an end face of the plate on the "female" non-circular surface;

performing injection molding, locking the hollow semi-cylinder having a "male" non-circular surface with the hollow semi-cylinder having a "female" non-circular surface by buckling to form a complete cylindrical cooling filter rod, and cutting into suitable lengths of filter rods for cigarettes or for compounding.

* * * * *